US010247024B2

(12) United States Patent
Dev et al.

(10) Patent No.: US 10,247,024 B2
(45) Date of Patent: Apr. 2, 2019

(54) SEAL ASSEMBLY FOR A TURBOMACHINE

(71) Applicant: GENERAL ELECTRIC COMPANY, Schenectady, NY (US)

(72) Inventors: Bodhayan Dev, Niskayuna, NY (US); Neelesh Nandkumar Sarawate, Schenectady, NY (US); Jason Edward Albert, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 495 days.

(21) Appl. No.: 14/963,019

(22) Filed: Dec. 8, 2015

(65) Prior Publication Data

US 2017/0159479 A1 Jun. 8, 2017

(51) Int. Cl.

| | |
|---|---|
| ***F01D 11/00*** | (2006.01) |
| ***F04D 29/08*** | (2006.01) |
| ***F01D 25/24*** | (2006.01) |

(52) U.S. Cl.

CPC ..... *F01D 11/006* (2013.01); *F01D 25/246* (2013.01); *F04D 29/083* (2013.01); *F05D 2240/57* (2013.01); *F05D 2250/61* (2013.01)

(58) Field of Classification Search

CPC . F01D 11/006; F01D 5/02; F01D 5/12; F01D 9/041; F16J 15/0887; F05D 2220/32

See application file for complete search history.

(56) References Cited

U.S. PATENT DOCUMENTS

| | | | | |
|---|---|---|---|---|
| 4,484,858 | A * | 11/1984 | Kurosawa | F01D 11/005 416/193 A |
| 5,088,888 | A | 2/1992 | Bobo | |
| 5,154,577 | A | 10/1992 | Kellock et al. | |
| 5,868,398 | A | 2/1999 | Maier et al. | |
| 6,932,567 | B2 | 8/2005 | Albers et al. | |
| 7,497,443 | B1 * | 3/2009 | Steinetz | F16J 15/0887 277/644 |
| 8,075,255 | B2 | 12/2011 | Morgan | |
| 8,613,451 | B2 * | 12/2013 | Samudrala | F16J 15/0812 277/644 |
| 8,690,158 | B2 | 4/2014 | Beeck | |
| 8,794,640 | B2 | 8/2014 | Bergman et al. | |
| 2012/0007318 | A1 | 1/2012 | Lee et al. | |

OTHER PUBLICATIONS

H. Nakane et al., "The Development of High Performance Leaf Seals", ASME Turbo Expo 2002: Power for Land, Sea, and Air, vol. 3: Turbo Expo 2002, Jun. 3-6, 2002, Amsterdam, The Netherlands.

Aksit et al., "Parasitic corner leakage reduction in gas turbine nozzle-shroud inter-segment locations", Joint Propulsion Conferences, 37th Joint Propulsion Conference and Exhibit, American Institute of Aeronautics and Astronautics.

Steinetz, Bruce M. et al.; "High Temperature Braided Rope Seals for Static Sealing Applications", NASA Technical Memorandum 107233 Revised Copy, Jul. 1-3, 1996, pp. 1-14, http://ntrs.nasa.gov/archive/nasa/casi.ntrs.nasa.gov/19960038390.pdf.

* cited by examiner

*Primary Examiner* — Gilbert Y Lee

(74) *Attorney, Agent, or Firm* — GE Global Patent Operation; John Darling

(57) ABSTRACT

The present disclosure relates to a turbomachine that includes a first component and a second component coupled to another and a seal assembly between the two components. The seal assembly may include an upstream corner shim and a downstream corner shim, where one of the upstream corner shim or the downstream corner shim includes a pressure actuation feature configured to block a flow of gas between the two components.

20 Claims, 7 Drawing Sheets

SEAL ASSEMBLY FOR A TURBOMACHINE

BACKGROUND

The subject matter disclosed herein relates to turbomachines, and more specifically to a sealing assembly between portions of a turbomachine component.

A variety of turbomachines, such as turbines and compressors, may include seals disposed between segments. For example, a gas turbine may include stationary portions (e.g., stators) arranged circumferentially about a rotor. Unfortunately, the segments may experience thermal expansion and contraction, vibration, bending, and other forces, which can reduce the effectiveness of traditional seals. Furthermore, traditional seals between stationary portions may experience substantial pressure differences between different fluid flows, such as a hot gas flow driving the turbine blades and a coolant air flow for cooling the segments. As a result, traditional seals may experience leakage, which can reduce performance and reliability of the turbomachine (e.g., gas turbine). Accordingly, it is now recognized that an enhanced seal is desired.

BRIEF DESCRIPTION

In one embodiment, a turbomachine includes a first component that has a first seal slot with a first corner, a second component coupled to the first component, where the second component includes a second seal slot with a second corner. The turbomachine also includes a gap between the first component and the second component and a seal assembly disposed in the first component, the second component, and a portion of the gap. The seal assembly includes a first corner shim and a second corner shim, where the first shim includes a pressure actuation feature configured to cover end gaps in the first seal slot, the second seal slot, or both when a pressure in the gap exceeds a threshold biasing force of the pressure actuation feature.

In another embodiment, a power generation system includes a turbomachine, a first component of the turbomachine that has a first seal slot, where the first seal slot includes a first segment and a second segment coupled to one another by a first corner, a second component of the turbomachine coupled to the first component, where the second component includes a second seal slot, and the second seal slot has a third segment and a fourth segment coupled to one another by a second corner. The power generation system also includes a gap between the first component and the second component and a seal assembly disposed in the first seal slot, the second seal slot, and a portion of the gap. The seal assembly includes a first corner shim disposed in the first segment, the second segment, the third segment, and the fourth segment and a second corner shim disposed in the first segment, the second segment, the third segment, and the fourth segment. The second corner shim includes a pressure actuation feature configured to cover end gaps in the first seal slot, the second seal slot, or both when a pressure in the gap exceeds a threshold biasing force of the pressure actuation feature.

In another embodiment, a method includes disposing a first portion of a seal assembly in a first seal slot of a first component of a turbomachine, where the seal assembly includes a first corner shim and a second corner shim, and the first corner shim includes a pressure actuation feature. The method also includes disposing a second portion of the seal assembly in a second seal slot of a second component of the turbomachine and coupling the first component to the second component to form a gap between the first component and the second component. The pressure actuation feature is configured to cover end gaps in the first seal slot, the second seal slot, or both when a pressure in the gap exceeds a threshold biasing force of the pressure actuation feature.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
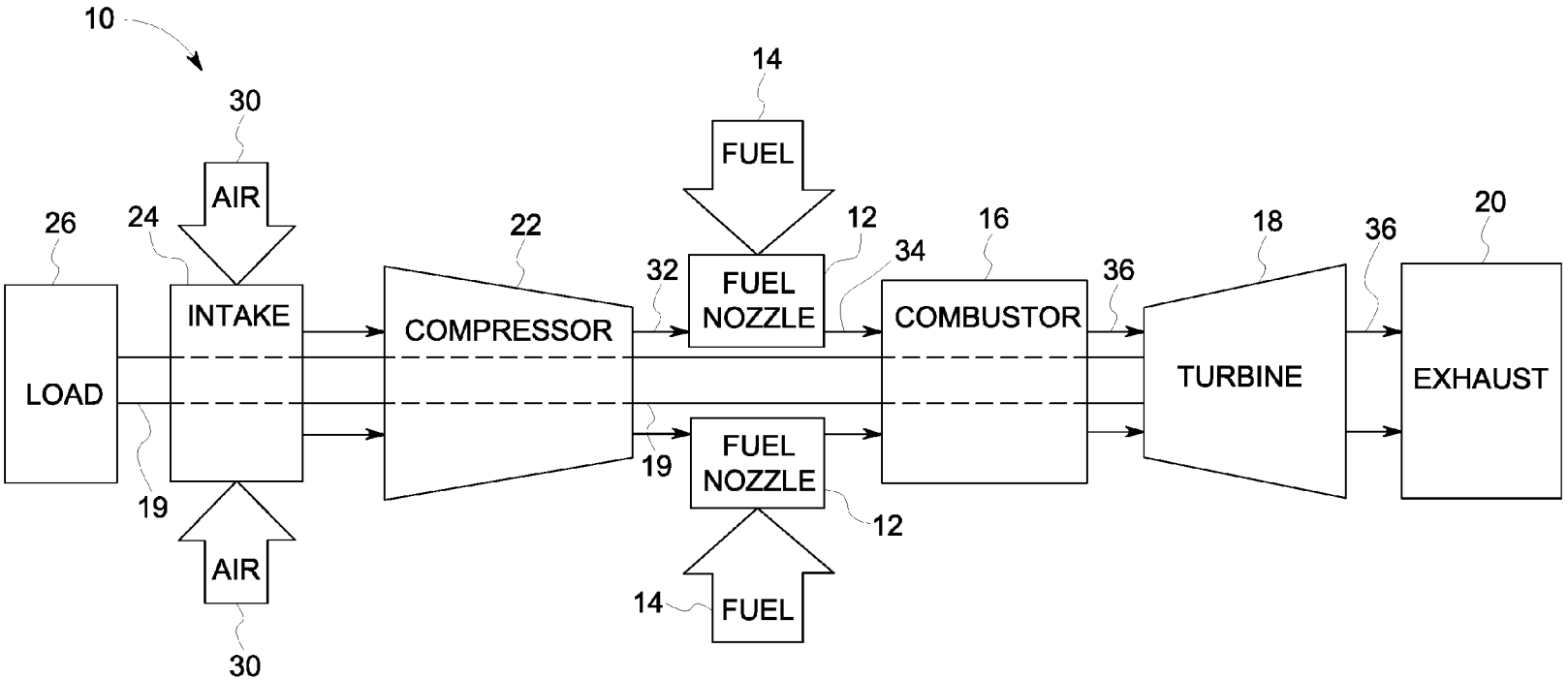
FIG. 1 is a block diagram of an embodiment of a gas turbine system, in accordance with an aspect of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Power generation systems may include turbomachines (e.g., compressors and/or turbines) that may be utilized to ultimately power a load (e.g., a power plant). Turbomachines include elements that may move (e.g., rotate) or remain substantially stationary with respect to a shaft utilized to drive the load. For example, a turbomachine may include rotors (e.g., components that rotate about the shaft) and stators (e.g., components that remain substantially stationary with respect to the shaft). In some cases, the turbomachine may be formed from multiple components that are coupled to one another. However, coupling the components together may form one or more gaps between components, which may enable fluid (e.g., gas) to flow through the components. It may be undesirable for fluid to flow between the components because it may reduce an efficiency of the turbomachine. For example, hot combustion gases may contact a first side of a component and a cooling fluid may contact a second side of the component. The flow of combustion gases may be configured to spin the rotor and/or the shaft, which may power the load. However, the combustion gases may also increase a temperature of the component via the contact with the first side. Accordingly, the cooling fluid may contact the second side of the component to maintain the temperature of the component at a desired level during operation (e.g., when exposed to hot combustion gases). Mixing the cooling fluid and the hot combustion gases with one another may reduce a cooling efficiency of the turbomachine because the temperature of the cooling fluid may be increased, thereby leading to an increased temperature of the turbomachine component.

To separate the cooling fluid and the hot combustion gases, traditional turbomachines include seals between the components to fill the gap. Therefore, each individual component may include a seal slot configured to receive the seal. However, manufacturing tolerances may cause the seal disposed in the seal slots to leave openings that still provide a path for the cooling fluid and/or the hot combustion gases flow between two components. Therefore, it is now recognized that an enhanced seal assembly is desired to reduce leakage of the cooling fluid and/or the hot combustion gases between the components. In accordance with embodiments of the present disclosure, the seal assembly may include an upstream corner shim (e.g., a first corner shim) and a downstream corner shim (e.g., a second corner shim) where one of the upstream shim or the downstream shim includes a pressure actuated feature. Such a seal assembly may block a flow of the cooling fluid and/or the hot combustion gases through corners and/or edges of the seal slots, thereby reducing leakage and enhancing an efficiency of the turbomachine.

Turning now to the drawings and referring first to FIG. 1, a block diagram of an embodiment of a gas turbine system 10 is illustrated. The diagram includes a fuel nozzle 12, fuel 14, and a combustor 16. As depicted, the fuel 14 (e.g., a liquid fuel and/or gas fuel, such as natural gas) is routed to the turbine system 10 through the fuel nozzle 12 into the combustor 16. The combustor 16 may ignite and combust an air-fuel mixture 34, and then pass hot pressurized exhaust gas 36 into a turbine 18. The exhaust gas 36 passes through turbine blades of a turbine rotor in the turbine 18, thereby driving the turbine 18 to rotate. In accordance with present embodiments, a seal assembly that includes an upstream corner shim and a downstream corner shim may be disposed within seal slots between rotor and/or stator segments within the turbine 18 to block hot exhaust gases 36 flowing through the turbine from mixing with a cooling fluid. The coupling between blades in the turbine 18 and a shaft 19 will cause the rotation of the shaft 19, which is also coupled to several components (e.g., a compressor 22, a load 26) throughout the turbine system 10. Eventually, the exhaust gases 36 of the combustion process may exit the turbine system 10 via an exhaust outlet 20.

In an embodiment of the turbine system 10, compressor vanes or blades are included in the compressor 22. Blades within the compressor 22 may be coupled to the shaft 19, and will rotate as the shaft 19 is driven to rotate by the turbine 18. The compressor 22 may intake air 30 into the turbine system 10 via an air intake 24. Further, the shaft 19 may be coupled to the load 26, which may be powered via rotation of the shaft 19. As appreciated, the load 26 may be any suitable device that may generate power via the rotational output of the turbine system 10, such as a power generation plant or an external mechanical load. For example, the load 26 may include an electrical generator, a propeller of an airplane, and so forth. The air intake 24 draws the air 30 into the turbine system 10 via a suitable mechanism, such as a cold air intake, for subsequent mixture of the air 30 with the fuel 14 via the fuel nozzle 12. The air 30 taken in by the turbine system 10 may be fed and compressed into pressurized air 32 by rotating blades within the compressor 22. The pressurized air 32 may then be fed into one or more of the fuel nozzles 12. The fuel nozzles 12 may then mix the pressurized air 32 and the fuel 14, to produce the air-fuel mixture 34 that is suitable for combustion (e.g., a combustion that causes the fuel 14 to more completely burn to minimize an amount of wasted fuel 14 and/or emissions in the exhaust gases 36). As discussed above, the turbine 18 is driven by the exhaust gases 36, and such exhaust gases may contact a first side of components of the turbine (e.g., the rotor and/or the stator). Accordingly, such segments may include a seal assembly that has one or more corner shims configured to block leakage between segments of the turbine components.

Figure 2:
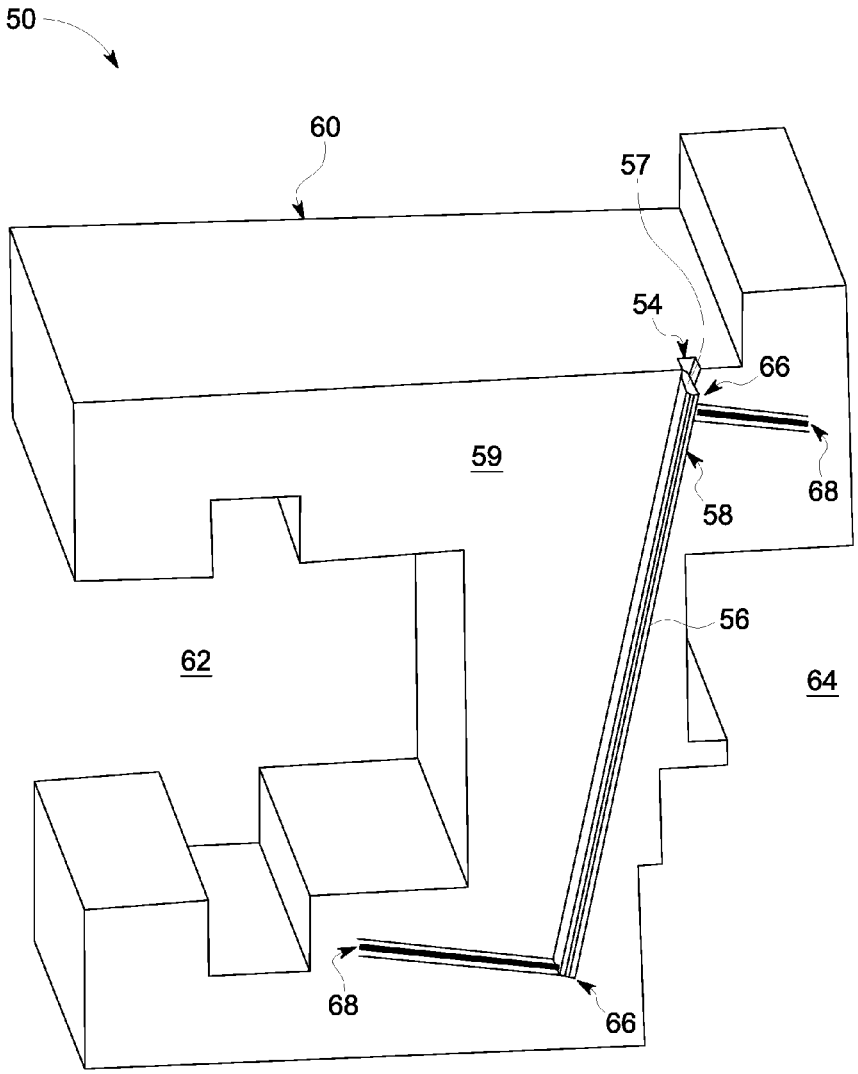
FIG. 2 is a perspective view of a component of the turbine system of FIG. 1 that includes a seal assembly disposed in a seal slot, in accordance with an aspect of the present disclosure.

FIG. 2 is a perspective view of a component 50 (e.g., a stator portion or a rotor portion) of the turbine 18 and/or the compressor 22 that includes a seal slot 54. In accordance with embodiments of the present disclosure, a seal assembly 56 (e.g., one or more corner shims) may be disposed in the seal slot 54 to block fluid flow between two components 50 coupled to one another. For example, a plurality of the components 50 may be coupled to one another to form a circular or cylindrical stator around the shaft 19, for example. Accordingly, a first portion 57 of the seal assembly 56 may be disposed in the seal slot 54 of the component 50 and a second portion 58 of the seal assembly 56 may be disposed in a seal slot of a second component. It should be noted that the turbine 18 and/or the compressor 22 may include multiple components 50 that each include one or more seal slots 54 and seal assemblies 56 (e.g., each component 50 may include a seal slot 54 on a first face 59 and a second face 60).

However, in some cases, a gap and/or opening may form when the component 50 is coupled to a second component, thereby enabling fluid (e.g., hot combustion gases and/or a cooling fluid) to flow from a first side 62 of the component 50 to a second side 64 of the component 50. To block the fluid from flowing between the first side 62 and the second side 64, the first portion 57 of the seal assembly 56 may be disposed in the seal slot 54 of the component 50 and the second portion 58 of the seal assembly 56 may be disposed in a second seal slot of the second component (e.g., see FIG. 3). Additionally, as shown in the illustrated embodiment of FIG. 2, the seal slot 54 may include one or more corners 66 to enhance the seal between the component 50 and the second component. However, existing seal assemblies may leave gaps at the corners 66 of the seal slots 54 and/or at ends 68 of the seal slot 54. Accordingly, it is now recognized that an enhanced seal assembly 56 may minimize any leakage of fluid through the corners 66 and/or the ends 68 of the seal slot 54. Minimizing leakage of the fluid flow between the first side 62 and the second side 64 may enhance an efficiency of the turbine system 10. The details of the sealing assemblies 56 are further described below with reference to FIGS. 3-6.

Figure 3:
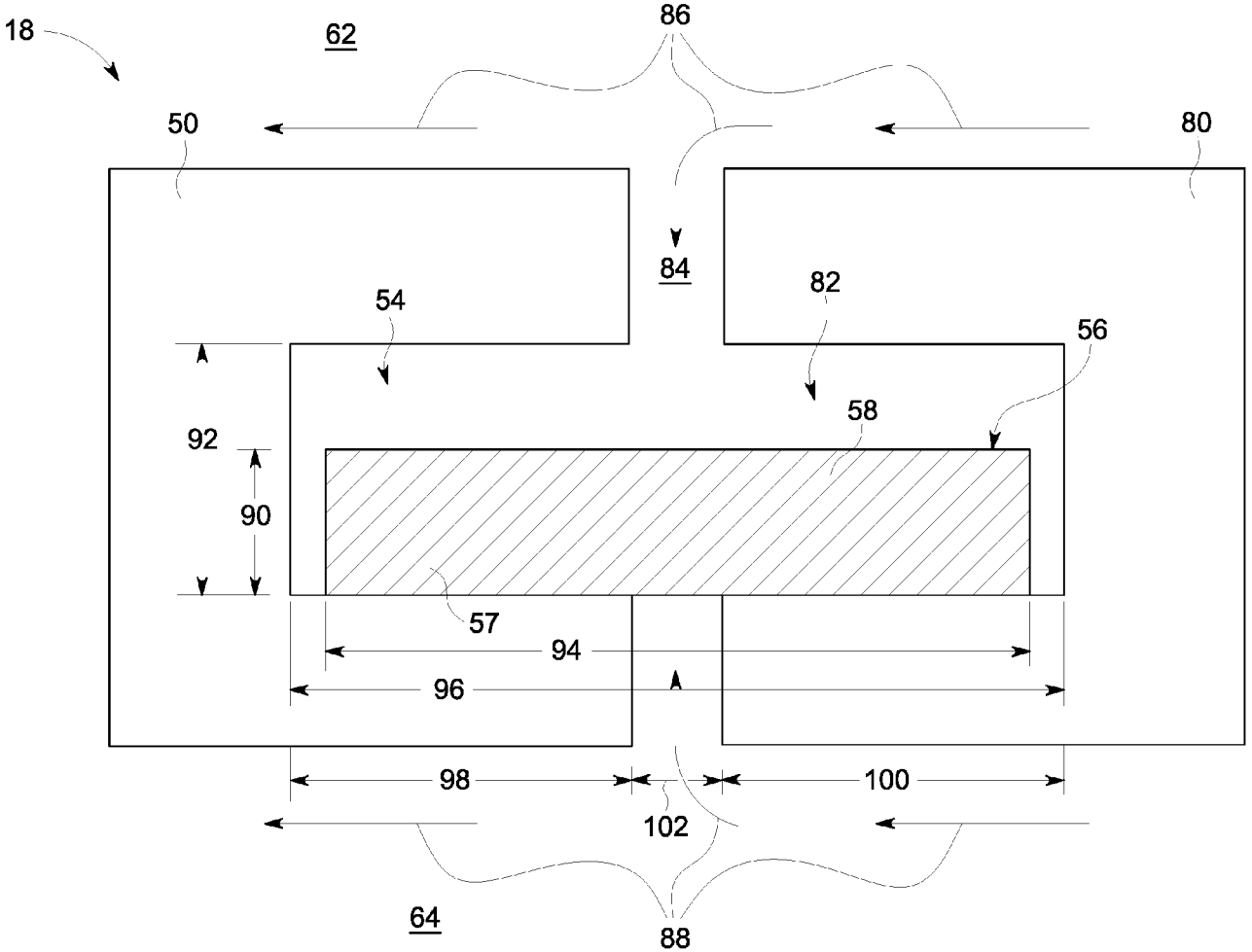
FIG. 3 is a cross-section of a portion of the turbine of the turbine system of FIG. 1 that includes a seal assembly disposed between the component of FIG. 2 and an additional component coupled to the component, in accordance with an aspect of the present disclosure.

For example, FIG. 3 shows a cross-section of a portion of the turbine 18 and/or the compressor 22 that includes the component 50 (e.g., the first component) and a second component 80 coupled to one another (e.g., via a coupling device not shown). Additionally, the first portion 57 of the seal assembly 56 is disposed in the seal slot 54 (e.g., the first seal slot) of the first component 50 and the second portion 58 of the seal assembly 56 is disposed in a second seal slot 82 of the second component 80. In some embodiments, the first and second components 50, 80 may include a first nozzle of a first stator and a second nozzle of a second stator, respectively. However, it should be noted that in other embodiments, the first and second components 50, 80 may be any other adjacent components of the turbine 18 and/or the compressor 22. Accordingly, the seal assemblies described herein may be configured for, or used with, any number or type of components of the turbine 18 and/or the compressor 22 that may be sealed to reduce leakage between the components.

As shown in the illustrated embodiment of FIG. 3, the first and second components 50, 80 may be spaced from one another such that a gap 84 extends between the first and second components 50, 80. Accordingly, the gap 84 may enable the fluid (e.g., combustion gases and/or cooling fluid) to flow between the first and second components 50, 80 (and from the first side 62 to the second side 64). In some configurations, the first and second components 50, 80 may be positioned between a first flow path 86 (e.g., a flow of hot combustion gases contacting the first side 62) and a second flow path 88 (e.g., a flow of cooling air contacting the second side 64). To block the first flow path 86 from mixing with the second flow path 88, the sealing assembly 56 may be disposed in the first seal slot 54 and in the second seal slot 82. The first and second seal slots 54, 82 may have any size, shape, or configuration capable of receiving the seal assembly 56. For example, as shown in the embodiment of FIG. 3, the first and second seal slots 54, 82 may be substantially similar to one another and adjacent to one another.

In some cases, manufacturing and assembly limitations and/or variations, as well as thermal expansion and/or movement during operation, may cause the first and second seal slots 54, 82 to be offset, skewed, twisted, angled or otherwise misaligned. For example, the first and second seal slots 54, 82 may include a substantially similar shape, but the relative positioning of the first and second seal slots 54, 82 may change as a result of use, wear or operating conditions. As used herein, the term "misaligned" may include configurations where the first and second seal slots 54, 82 are intentionally offset as well as configurations where an alignment of the first and second seal slots 54, 82 has changed due to operating conditions of the turbine system 10, for example. In embodiments where the seal slots 54, 82 are offset or are likely to become offset (e.g., when the turbine system 10 operates at high temperatures), the seal assembly 56 may include a flexible material such that the seal assembly 56 may be manipulated to fit in both the first seal slot 54 and the second seal slot 82, offset from the first seal slot 54.

As shown in the illustrated embodiment of FIG. 3, a thickness 90 of the seal assembly 56 may be less than a thickness 92 of the first seal slot 54 and/or the second seal slot 82. In some embodiments, the thickness 90 of the seal assembly 56 may be between 25 mm and 150 mm, between 50 mm and 130 mm, or between 60 mm and 120 mm. Additionally, the seal assembly 56 may include a width 94 less than a width 96, where the width 96 is the sum of a first width 98 of the first seal slot 56, a second width 100 of the second seal slot 82, and a third width 102 of the gap 84.

As discussed above with reference to FIG. 2, the first seal slot 54 and/or the second seal slot 82 may not be a simple straight groove that lies within a single plane. For example, the first seal slot 54 and/or the second seal slot 82 may include one or more of the corners 66 to provide an enhanced seal. However, traditional seals may enable leakage between the components 50, 80 through the corners 66 and/or through end gaps of the seal slots 54, 82. Accordingly, enhanced configurations of the seal assembly 56 may be utilized to minimize leakage between the first component 50 and the second component 80.

Figure 4:
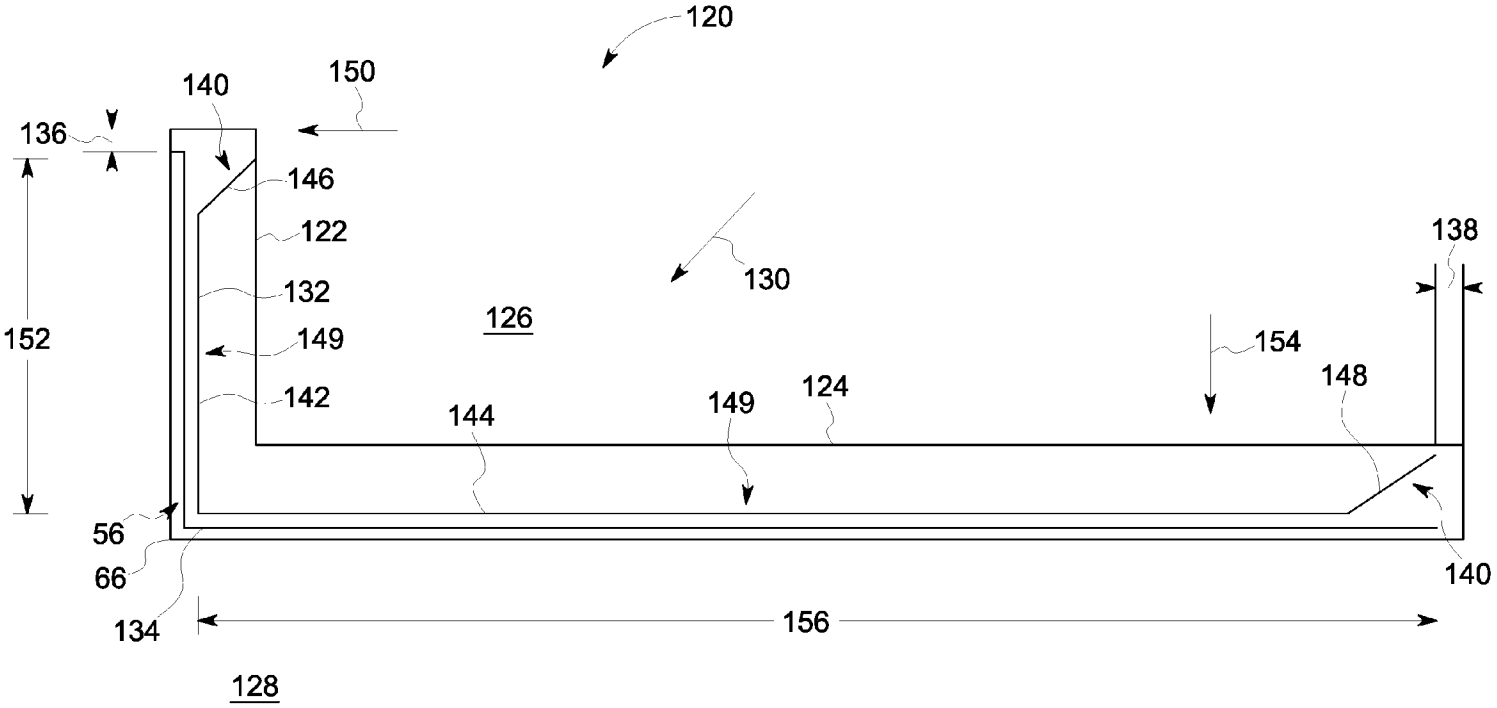
FIG. 4 is a block diagram of an embodiment of the seal assembly of FIGS. 2 and 3 that includes a corner shim having a pressure actuation feature that includes deformable features of the upstream corner shim, in accordance with an aspect of the present disclosure.

For example, FIG. 4 is a block diagram illustrating an embodiment of the seal assembly 56 configured to be disposed in a seal slot 120 having an "L" shape (e.g., a first segment and a second segment joined by a corner). While the illustrated embodiment of FIG. 4 shows the seal slot 120 having the "L" shape, it should be noted that embodiments of the presently disclosed seal assembly 56 may be configured for any suitable configuration of seal slot. Accordingly, the seal slot 120 includes the corner 66. For example, the seal slot 120 may include a vertical portion 122 and a horizontal portion 124, which are joined at the corner 66. Additionally, the seal slot may separate an upstream portion 126 (e.g., the first side 62) and a downstream portion 128 (e.g., the second side 64) of the first component 50. Accordingly, the upstream portion 126 may include a higher pressure than the downstream portion 128, such that fluid may flow from the upstream portion 126 toward the downstream portion 128 in a direction 130. In traditional seal assemblies, the corner 66 may facilitate leakage between the first component 50 and the second component 80 because traditional sealing devices (e.g., laminates and/or shims) are substantially planar, and thus not able to fully conform to and seal the corner 66. Further, a conjoined intersegment seal (e.g., two or more laminate seals connected to one another) may still incur a relatively large amount of leakage at ends of the seal slot because of manufacturing and assembly tolerances (e.g., the conjoined intersegment seal has a length less than the seal slot so that it may fit within the seal slot).

As shown in the illustrated embodiment of FIG. 4, the seal assembly 56 includes an upstream corner shim 132 (e.g., a first corner shim) and a downstream corner shim 134 (e.g., a second corner shim). As used herein, a "corner shim" may include a sealing device that may include two or more members (e.g., planar pieces of material) connected by one or more corners (e.g., a joint between two members). In some embodiments, the upstream corner shim 132 and/or the downstream corner shim 134 may include a high temperature alloy material such as nickel-based alloys, titaniumbased alloys, and/or cobalt-based alloys. Additionally, the upstream corner shim 132 and/or the downstream corner shim 134 may include a thickness of between 1 millimeter (mm) and 20 mm, 2 mm and 15 mm, or 8 mm and 12 mm.

In certain embodiments, the upstream corner shim 132 may be positioned proximate to the upstream portion 126 and the downstream corner shim 134 may be positioned proximate to the downstream portion 128 (e.g., the downstream corner shim 134 is positioned farther along the direction 130 than the upstream corner shim 132). When the upstream corner shim 132 and the downstream corner shim 134 are disposed in the seal slot 120, a first end gap 136 may be formed in the vertical portion 122 and a second end gap 138 may be formed in the horizontal portion 124. The end gaps 136, 138 may form as a result of manufacturing and/or assembly tolerances that limit a size of the upstream corner shim 132 and the downstream corner shim 134. For example, the upstream corner shim 132 and the downstream corner shim 134 may be sized to form the gaps 136 and 138 to ensure that the upstream corner shim 132 and the downstream corner shim 134 may fit within the seal slot 120. However, the end gaps 136 and 138 may be undesirable because fluid may flow from the upstream portion 126 toward the downstream portion 128 through the first end gap 136 and/or the second end gap 138. It is now recognized that features may be included in the upstream corner shim 132 or the downstream corner shim 134 to substantially cover the end gaps 136 and/or 138, and thus, reduce an amount of leakage from the upstream portion 126 to the downstream portion 128.

For example, the upstream corner shim 132 or the downstream corner shim 134 may include a pressure actuation feature 140. In the illustrated embodiment of FIG. 4, the upstream corner shim 132 includes the pressure actuation feature 140. However, it should be recognized that the downstream corner shim 134 may include the pressure actuation feature 140 in other embodiments. The upstream corner shim 132 may include a vertical portion 142 and a horizontal portion 144 that are disposed in the vertical portion 122 and the horizontal portion 124 of the seal slot 120, respectively. In accordance with some embodiments of the present disclosure, the pressure actuation feature 140 may be a first deformable feature 146 of the vertical portion 142 and a second deformable feature 148 of the horizontal portion 144. As used herein a "deformable feature" may be a portion of the upstream corner shim 132 or the downstream corner shim 134 that is angled from a base portion 149 of the vertical portion 142 and/or the horizontal portion 144. The deformable features 146, 148 may be configured to be "deformed" when a pressure force in the upstream portion 126 exceeds a threshold, thereby causing the deformable features 146, 148 to flatten and/or compress. In some embodiments, when the pressure force is removed, the deformable features 146, 148 may return to the angled position from the base portion 149 (e.g., the deformable features 146, 148 are reversible). In other embodiments, the deformable features 146, 148 may remain in a flattened position even when the pressure force is removed (e.g., the deformable features 146, 148 are irreversible).

The first deformable feature 146 of the vertical portion 142 and the second deformable feature 148 of the horizontal portion 144 may be configured to substantially cover the end gaps 136 and/or 138, thereby blocking fluid leakage between the first component 50 and the second component 80 via the gaps 136 and/or 138. For example, as pressure builds in the upstream portion 126, the first deformable feature 146 may be directed in a first direction 150 such that the first deformable feature 146 flattens, thereby increasing a first length 152 of the vertical portion 142 to substantially cover the first end gap 136. Similarly, as the pressure builds in the upstream portion 126, the second deformable feature 148 may be directed in a second direction 154 such that the second deformable feature 148 flattens, thereby increasing a second length 156 of the horizontal portion 144 to substantially cover the second end gap 138. Accordingly, the first length 152 and the second length 156 may enable the upstream corner shim 132 to be disposed in the seal slot 120 during assembly, however, when the deformable features 146 and/or 148 flatten, the increase in length may cause the upstream corner shim 132 to exceed tolerance levels of the seal slot 120. Thus, the deformable features 146 and 148 enable the upstream corner shim 132 to cover the gaps 136 and 138, while adhering to manufacturing and/or assembly tolerance specifications.

In some embodiments, the first deformable feature 146 may be a predetermined percentage of the vertical portion 142. For example, the first deformable feature 146 may be between 1% and 75% of the vertical portion 142, between 2% and 55% of the vertical portion 142, between 3% and 50% of the vertical portion 142, or any combination thereof. Similarly, the second deformable feature 148 may be a predetermined percentage of the horizontal portion 144. For example, the second deformable feature 148 may be between 1% and 75% of the horizontal portion 144, between 2% and 55% of the horizontal portion 144, between 3% and 50% of the horizontal portion 144, or any combination thereof. In other embodiments, the first deformable feature 146 and/or the second deformable feature 148 may be any suitable percentage of the vertical portion 142 and the horizontal portion 144, respectively, such that the first deformable feature 146 and/or the second deformable feature 148 may substantially cover the end gaps 136 and 138 to block leakage of fluid between the components 50 and 80.

Figure 5:
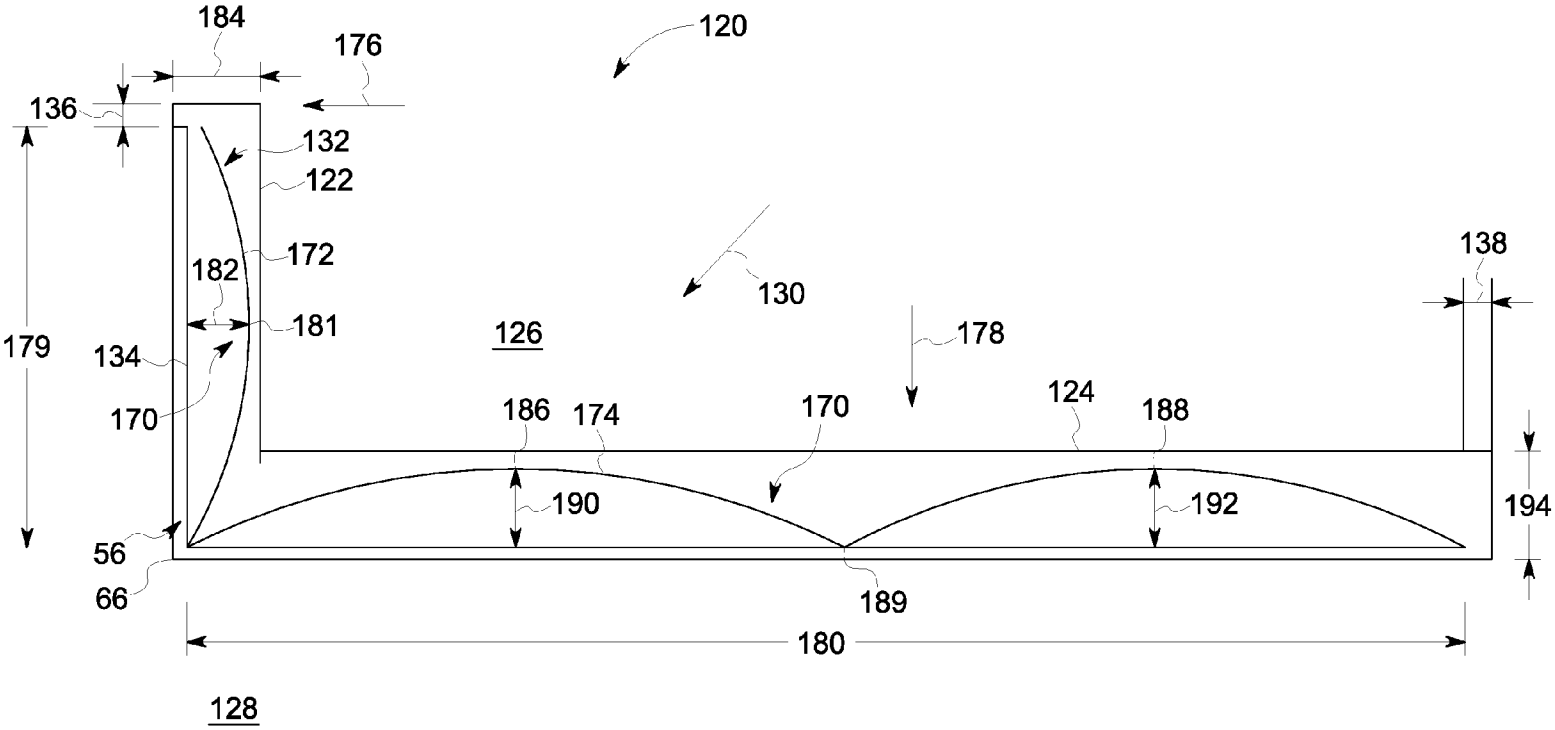
FIG. 5 is a block diagram of an embodiment of the seal assembly of FIGS. 2 and 3 that includes a corner shim having a pressure actuation feature that includes a corrugated vertical portion and a single-corrugated horizontal portion, in accordance with an aspect of the present disclosure.

The illustrated embodiment of FIG. 4 shows the upstream corner shim 132 having the pressure actuation feature 140, where the pressure actuation feature 140 includes the first deformable feature 146 and the second deformable feature 148. However, the pressure actuation feature 140 may include other configurations, such as those shown in the embodiments of FIGS. 5 and 6. For example, FIG. 5 is a block diagram of the seal assembly 56 disposed in the seal slot 120 and having a corrugated pressure actuation feature 170. As shown in the illustrated embodiment of FIG. 5, the upstream corner shim 132 includes a corrugated vertical portion 172 and a single-corrugated horizontal portion 174. As discussed above, as pressure may build in the upstream portion 126, which may eventually lead to fluid leakage through the end gaps 136 and/or 138. Accordingly, the corrugated vertical portion 172 and/or the single-corrugated horizontal portion 174 may be utilized to substantially cover the end gaps 136 and/or 138, thereby blocking fluid flow through the end gaps 136 and/or 138.

For example, when pressure builds in the upstream portion 126, a first force 176 may be applied to the corrugated vertical portion 172 and/or a second force 178 may be applied to the single-corrugated horizontal portion 174. In some embodiments, the first force 176 and the second force 178 may be applied simultaneously. In other embodiments, pressure from the upstream portion 126 may apply the first force 176 and the second force 178 separately. In any case, the corrugated vertical portion 172 may be configured to collapse (e.g., compress and/or flatten) when the first force 176 exceeds a first threshold biasing force of the corrugated vertical portion 172. Similarly, the single-corrugated horizontal portion 174 may be configured to collapse (e.g., compress and/or flatten) when the second force 178 exceeds a second threshold biasing force of the single-corrugated horizontal portion 174. In some embodiments, the first and/or second threshold biasing forces may correspond to a flow rate of fluid between the first and second components 50, 80 that may reduce a performance of the turbine system 10 beyond a predetermined tolerance level. Accordingly, when the first and/or second biasing forces are exceeded by the first and/or second forces 176, 178, the vertical corrugated portion 172 and/or the single-corrugated horizontal portion 174 may collapse (e.g., compress and/or flatten), thereby increasing a third length 179 of the vertical portion 142 and/or a fourth length 180 of the horizontal portion 144, respectively. In accordance with present embodiments, increasing the third length 179 and/or the fourth length 180 may substantially cover the first end gap 136 and/or the second end gap 138, thereby substantially blocking the flow of gas between the first and second components 50, 80.

In some embodiments, collapsing (e.g., compressing and/or flattening) the corrugated vertical portion 172 and/or the single-corrugated horizontal portion 174 may be reversible. In such embodiments, when the first force 176 and/or the second force 178 no longer exceed the first and second threshold biasing forces, respectively, the corrugated vertical portion 172 and/or the single-corrugated horizontal portion 174 may be configured to return to a position that leaves the gaps 136 and/or 138 uncovered. In other embodiments, when the corrugated vertical portion 172 and/or the single-corrugated horizontal portion 174 collapse, they may remain collapsed (e.g., collapsing may be irreversible).

As shown in the illustrated embodiment of FIG. 5, the corrugated vertical portion 172 includes a single curved portion 181. In certain embodiments, the single curved portion 181 includes a height 182 that is less than a thickness 184 of the vertical portion 122 of the seal slot 120. In other embodiments, the height 182 of the curved portion 181 may be substantially equal to the thickness 184 of the vertical portion 122. Similarly, the single-corrugated horizontal portion 174 includes a first curved portion 186 and a second curved portion 188 separated by a single kink 189. The first curved portion 186 includes a first height 190 and the second curved portion 188 includes a second height 192. As shown in the illustrated embodiment of FIG. 5, the first height 190 and the second height 192 are both less than a thickness 194 of the horizontal portion 124 of the seal slot 120. However, in other embodiments, the first and second heights 190, 192 may be substantially equal to the thickness 194 of the horizontal portion 124. Additionally, the first height 190 and the second height 192 may be substantially equal or different. It should be noted that the first height 190 and the second height 192 may at least partially define the second threshold biasing force. Accordingly, the first height 190 and the second height 192 may be configured to such that the second threshold biasing force is at a suitable level to enable the single-corrugated horizontal portion 174 to collapse when leakage may occur through the second end gap 138.

In the illustrated embodiment of FIG. 5, the vertical corrugated portion 172 includes the single curved portion 181. However, in other embodiments, the vertical corrugated portion 172 may include any suitable number of curved portions to enable the vertical corrugated portion 172 to collapse when a pressure force exerted by the fluid in the upstream portion 126 exceeds the first threshold biasing force. Additionally, the single-corrugated portion 174 of the upstream corner shim 132 includes the first curved portion 186 and the second curved portion 188 separated by the single kink 189. However, in other embodiments, the horizontal portion 144 of the upstream corner shim 132 may include more than two curved portions (e.g., more than one kink), a single curved portion, or features in addition to curved portions.

Figure 6:
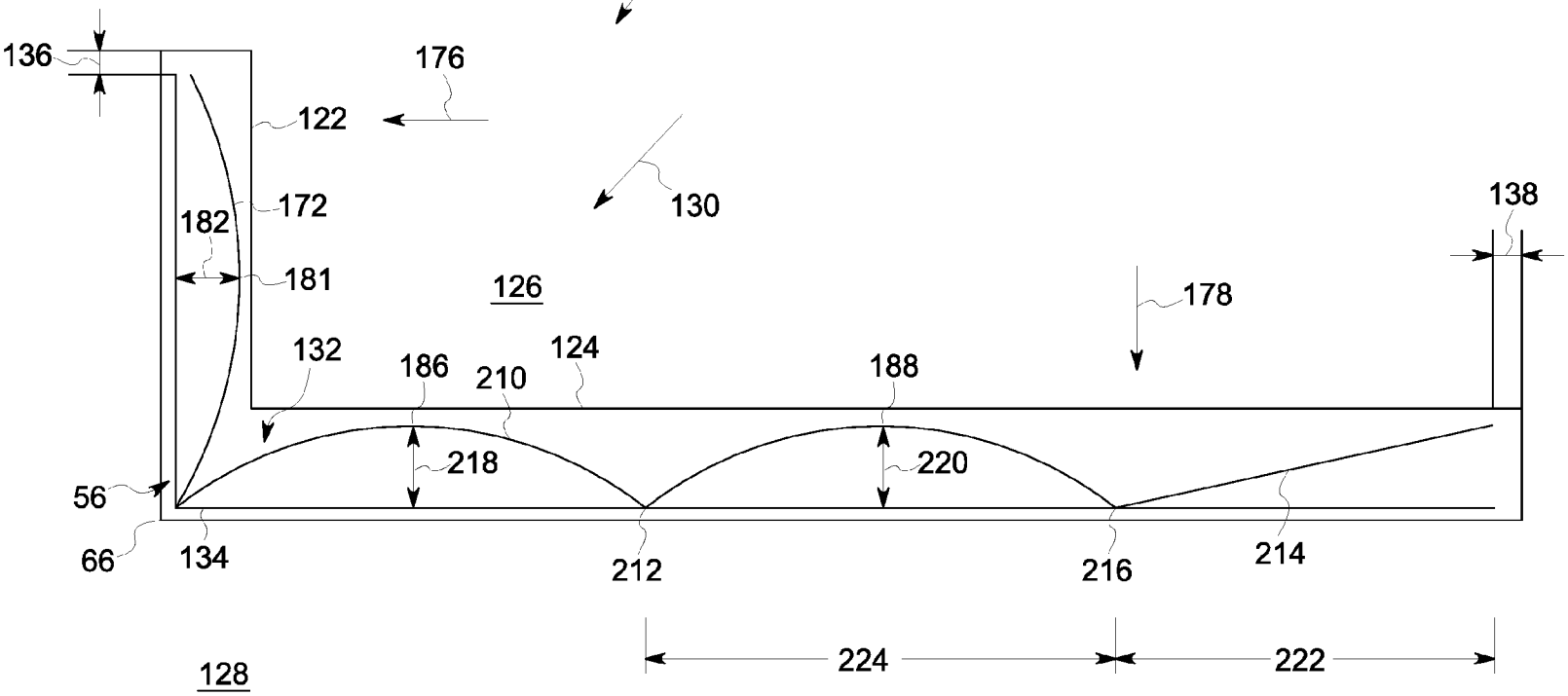
FIG. 6 is a block diagram of an embodiment of the seal assembly of FIGS. 2 and 3 that includes a corner shim having a pressure actuation feature that includes a corrugated vertical portion and a dual-corrugated horizontal portion, in accordance with an aspect of the present disclosure.

For example, FIG. 6 is a block diagram of an embodiment of the seal assembly 56 disposed in the seal slot 120 having the vertical corrugated portion 172 and a dual-corrugated horizontal portion 210. As shown in the illustrated embodiment of FIG. 6, the dual-corrugated horizontal portion 210 may include the first curved portion 186 and the second curved portion 188 separated by a first kink 212. In addition, the dual-corrugated horizontal portion 210 includes a deformable feature 214 separated from the second curved portion 188 by a second kink 216.

As shown in the illustrated embodiment of FIG. 6, the first curved portion 186 may include a third height 218 and the second curved portion 188 may include a fourth height 220. The third height 218 and the fourth height 220 may determine a length 222 of the deformable feature 214 and/or a distance 224 between the first kink 212 and the second kink 216. In some embodiments, the third height 218, the fourth height 220, the length 222, and/or the distance 224 between the first and second kinks 212, 216 may determine a third threshold biasing force. When the second force 178 exceeds the third threshold biasing force, the dual-corrugated horizontal portion 210 may be configured to collapse (e.g., compress and/or flatten) such that the dual-corrugated horizontal portion 210 increases in length to substantially cover the gap 138. In some embodiments, the third biasing force may correspond to a flow rate of fluid between the first and second components 50, 80 that may reduce performance of the system 10 beyond a predetermined tolerance level. Accordingly, the third height 218, the fourth height 220, the length 222, and/or the distance 224 of the dual-corrugated horizontal portion 210 may be configured such that an appropriate third threshold biasing force is exerted by the dual-corrugated horizontal portion 210.

Figure 7:
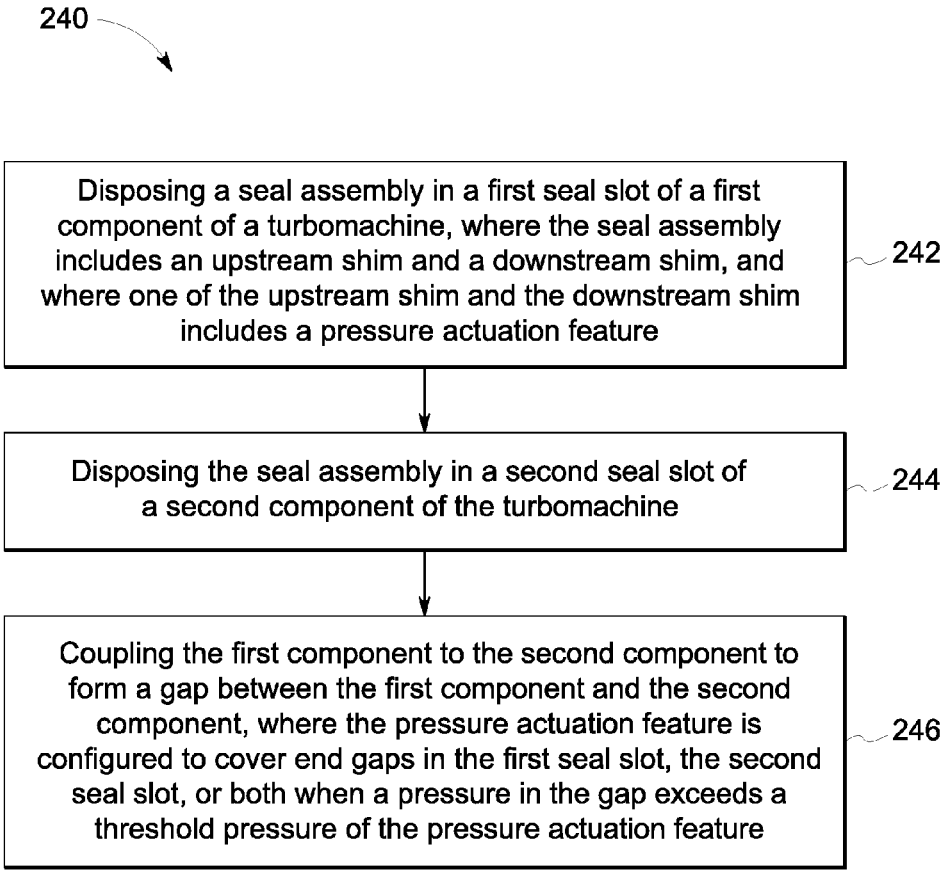
FIG. 7 is a block diagram of a process that may be used to manufacture the turbine of FIG. 3 that includes the seal assembly of FIGS. 4-6, in accordance with an aspect of the present disclosure.

To manufacture the turbine system 10 that includes embodiments of the seal assembly 56 described in the present disclosure, a process 240 may be performed, as shown in FIG. 7. For example, at block 242, the first portion 57 of the seal assembly 56 may be disposed in the first seal slot 54 of the first component 50. As discussed above, in certain embodiments the seal assembly 56 may include the upstream corner shim 132 and the downstream corner shim 134 when the first seal slot 54 includes the "L" shape (e.g., has a first segment and a second segment joined by a first corner). Additionally, either the upstream corner shim 132 or the downstream corner shim 134 may include the pressure actuation feature 140 (e.g., the deformable features, the single-corrugated portion, and/or the dual-corrugated portion). Although the discussion of FIG. 5 focuses on the seal slot 54 (and the second seal slot 82) having an "L" shape, it should be recognized that the seal assembly 56 may be configured to be disposed in any suitable seal slots 54 and/or 82 to substantially block the fluid from flowing through the gap 84 formed between the first component 50 and the second component 80.

At block 244, the second portion 58 of the seal assembly 56 may be disposed in the second seal slot 82 of the second component 80. Accordingly, at block 246, the first component 50 may be coupled to the second component 80 (e.g., via a fastener such as a screw, a rivet, a clamp, or another securement device). In some embodiments, the steps described in blocks 244 and 246 may occur simultaneously. In other embodiments, the step described in block 246 may occur either before or after the step described in block 244. When the second portion 58 of the seal assembly 56 is disposed in the second seal slot 82, the gap 84 between the first component 50 and the second component 80 may be sealed, such that the fluid flowing between the components 50, 80 is blocked by the seal assembly 56. Moreover, the pressure actuation feature 140 included in the upstream corner shim 132 or the downstream corner shim 134 may enhance the seal between the components 50, 80. For example, the seal assembly 56 may block fluid from flowing through the corner 66 as well as through the end gaps 136 and 138. When the pressure in the gap 84 exceeds the threshold biasing force of the pressure actuation feature 140, the pressure actuation feature 140 may collapse (e.g., compress and/or flatten), thereby increasing a length of the upstream shim 132 or the downstream shim 134 to substantially cover the end gaps 136 and 138. Therefore, the seal assembly 56 may provide an enhanced seal between the first and second components 50, 80, thereby enhancing the efficiency of the turbine system 10.

Technical effects of the invention include a sealing assembly disposed between components of a turbomachine that may enhance an efficiency of the turbomachine. In accordance with embodiments of the present disclosure, the sealing assembly may include an upstream corner shim and a downstream corner shim, where one of the upstream corner shim or the downstream shim includes a pressure actuation feature. The pressure actuation feature may be configured to increase a length of one or more portions of the shim such that end gaps formed due to manufacturing tolerances are substantially covered when a pressure between turbine components exceeds a threshold level. In certain embodiments, the pressure actuation feature may include a deformable feature of the shim, a single-corrugated shim, a dual-corrugated shim, or any combination thereof. Such a seal assembly may block a flow of gas between the components, and specifically, block the flow of gas through corners and/or ends of a seal slot configured to receive the seal assembly, which may ultimately enhance an efficiency of the turbomachine This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A turbomachine comprising:

a first component comprising a first seal slot with a first corner;

a second component coupled to the first component, wherein the second component comprises a second seal slot with a second corner;

a gap between the first component and the second component; and a seal assembly disposed in the first component, the second component, and a portion of the gap, wherein the seal assembly comprises a first corner shim and a second corner shim, and wherein each of the first corner shim and the second corner shim include two or more members connected by one or more corners and the first corner shim comprises a pressure actuation feature configured to cover end gaps in the first seal slot, the second seal slot, or both when a pressure in the gap exceeds a threshold biasing force of the pressure actuation feature.

2. The turbomachine of claim 1, wherein the first corner shim comprises a first portion and a second portion.

3. The turbomachine of claim 2, wherein the pressure actuation feature comprises a first deformable feature of the first portion and a second deformable feature of the second portion.

4. The turbomachine of claim 3, wherein the first deformable feature is between 3% and 50% of the first portion and the second deformable feature is between 3% and 50% of the second portion.

5. The turbomachine of claim 1, wherein the pressure actuation feature comprises a first corrugated portion of the first corner shim and a single-corrugated portion of the first corner shim.

6. The turbomachine of claim 5, wherein the single-corrugated portion comprises a first curved portion and a second curved portion separated by a single kink.

7. The turbomachine of claim 1, wherein the pressure actuation feature comprises a first corrugated portion of the first corner shim and a dual-corrugated portion of the first corner shim.

8. The turbomachine of claim 7, wherein the dual-corrugated portion of the first corner shim comprises a first kink and a second kink.

9. The turbomachine of claim 8, wherein the dual-corrugated portion comprises a first curved portion, a second curved portion, and a deformable feature, the first curved portion and the second curved portion are separated by the first kink, and the second curved portion and the deformable feature are separated by the second kink.

10. The turbomachine of claim 1, wherein the threshold biasing force is configured to be substantially equal to a pressure force corresponding to the fluid flowing through the end gaps.

11. A power generation system, comprising:

a turbomachine;

a first component of the turbomachine comprising a first seal slot, wherein the first seal slot comprises a first segment and a second segment coupled to one another by a first corner;

a second component of the turbomachine coupled to the first component, wherein the second component comprises a second seal slot, and the second seal slot comprises a third segment and a fourth segment coupled to one another by a second corner;

a gap between the first component and the second component; and a seal assembly positioned in the first seal slot, the second seal slot, and a portion of the gap, wherein the seal assembly comprises:

a first corner shim positioned in the first segment, the second segment, the third segment, and the fourth segment; and a second corner shim positioned in the first segment, the second segment, the third segment, and the fourth segment, wherein each of the first corner shim and the second corner shim include two or more members connected by one or more corners and the second corner shim comprises a pressure actuation feature configured to cover end gaps in the first seal slot, the second seal slot, or both when a pressure in the gap exceeds a threshold biasing force of the pressure actuation feature.

12. The turbomachine of claim 11, wherein the first corner shim comprises a first portion and a second portion.

13. The turbomachine of claim 12, wherein the pressure actuation feature comprises a first deformable feature of the first portion and a second deformable feature of the second portion.

14. The turbomachine of claim 11, wherein the pressure actuation feature comprises a first corrugated portion of the first corner shim and a single-corrugated portion of the first corner shim.

15. The turbomachine of claim 11, wherein the pressure actuation feature comprises a first corrugated portion of the first corner shim and a dual-corrugated portion of the first corner shim.

16. The power generation system of claim 11, wherein the threshold biasing force is configured to be substantially equal to a pressure force corresponding to the fluid flowing through the end gaps.

17. A method, comprising:

disposing a first portion of a seal assembly in a first seal slot of a first component of a turbomachine, wherein the seal assembly comprises a first corner shim and a second corner shim, and wherein each of the first corner shim and the second corner shim include two or more members connected by one or more corners and the first corner shim comprises a pressure actuation feature;

disposing a second portion of the seal assembly in a second seal slot of a second component of the turbomachine; and coupling the first component to the second component to form a gap between the first component and the second component, wherein the pressure actuation feature is configured to cover end gaps in the first seal slot, the second seal slot, or both when a pressure in the gap exceeds a threshold biasing force of the pressure actuation feature.

18. The method of claim 17, comprising forming the pressure actuation feature by bending a first portion of the first corner shim to form a first deformable feature of the first portion and bending a second portion of the first corner shim to form a second deformable feature of the second portion.

19. The method of claim 17, wherein the pressure actuation feature comprises a first corrugated portion of the first corner shim and a single-corrugated portion of the first corner shim.

20. The method of claim 17, wherein the pressure actuation feature comprises a first corrugated portion of the first corner shim and a dual-corrugated portion of the first corner shim.

* * * * *